US008794833B2

(12) United States Patent
Runyon et al.

(10) Patent No.: US 8,794,833 B2
(45) Date of Patent: Aug. 5, 2014

(54) TWO-HANDLED BAG

(75) Inventors: Michael Ray Runyon, Hutchinson, KS (US); Gregory A. Crites, Schuyler Falls, NY (US); Robert Kenny, Lilburn, GA (US); James A. McGillivary, Overland Park, KS (US); Larry Bloom, Atlanta, GA (US)

(73) Assignee: North American Salt Company, Overland Park, KS (US)

( * ) Notice: Subject to any disclaimer, the term of this patent is extended or adjusted under 35 U.S.C. 154(b) by 1153 days.

(21) Appl. No.: 12/200,728

(22) Filed: Aug. 28, 2008

(65) Prior Publication Data

US 2010/0054634 A1 Mar. 4, 2010

(51) Int. Cl.
*B65D 33/08* (2006.01)

(52) U.S. Cl.
USPC ..... 383/10

(58) Field of Classification Search
CPC ..... B65D 33/08; B65D 33/1683; B65D 75/5866; B65D 25/30; B65D 5/4608; B65D 77/06; B31B 19/86
USPC ..... 383/10, 16, 906, 20, 13, 91, 903; 222/466, 528
See application file for complete search history.

(56) References Cited

U.S. PATENT DOCUMENTS

| | | | | |
|---|---|---|---|---|
| 43,567 | A | | 7/1864 | Campbell |
| 470,169 | A | | 3/1892 | Bassett |
| 2,616,467 | A | | 11/1952 | Cicero |
| D235,739 | S | | 7/1975 | Christensen |
| 4,911,562 | A | | 3/1990 | Mazzeschi |
| 4,928,860 | A | * | 5/1990 | Knight ..... 222/466 |
| 5,338,117 | A | | 8/1994 | Kucksdorf et al. |
| 5,558,438 | A | * | 9/1996 | Warr ..... 383/10 |
| 5,593,229 | A | | 1/1997 | Warr |
| 5,782,562 | A | | 7/1998 | Anspacher |
| 5,882,120 | A | | 3/1999 | Bell |

(Continued)

FOREIGN PATENT DOCUMENTS

| | | | | |
|---|---|---|---|---|
| EP | 0132484 | | 2/1985 | |
| EP | 1277667 | A1 * | 1/2003 | ..... B65D 33/10 |

(Continued)

OTHER PUBLICATIONS

English translation of abstract related to FR2692868, espacenet.com, 1 page.

(Continued)

*Primary Examiner* — Gary Elkins
*Assistant Examiner* — Christopher Demeree
(74) *Attorney, Agent, or Firm* — Hovey Williams LLP

(57) ABSTRACT

A novel bag for holding, transporting, and pouring a bulk product is provided. The bag comprises two handles, with one handle being primarily configured for carrying (but also useful for pouring), and the other being primarily configured for pouring. The handles are positioned on adjacent sides of the bag, with the pouring handle being positioned near the bottom half of the bag to facilitate a controlled tilting of the bag. In one embodiment, the bag also includes a third handle on the same side of the bag as the pouring handle. The bag is typically formed of plastic, and can be used for salt, animal food, and other pourable products. The bag has a very high strength, with the second handle being particularly strong as a result of a longitudinal seam positioned adjacent that handle.

15 Claims, 4 Drawing Sheets

(56) References Cited

U.S. PATENT DOCUMENTS

| | | | | |
|---|---|---|---|---|
| 6,053,635 | A * | 4/2000 | Anderson et al. | 383/10 |
| 6,186,662 | B1 | 2/2001 | Jackson | |
| 6,299,351 | B1 | 10/2001 | Warr | |
| 6,921,201 | B2 | 7/2005 | Richardson et al. | |
| 6,923,574 | B2 | 8/2005 | Siegel | |
| D519,385 | S | 4/2006 | Lucas et al. | |
| 2002/0076471 | A1 | 6/2002 | Olsson | |
| 2002/0102032 | A1 * | 8/2002 | Sturgis et al. | 383/10 |
| 2002/0166779 | A1 | 11/2002 | Etesse et al. | |
| 2003/0059130 | A1 * | 3/2003 | Yoneyama et al. | 383/10 |
| 2004/0096127 | A1 | 5/2004 | Rosen | |
| 2005/0053313 | A1 | 3/2005 | Lucas et al. | |
| 2006/0210199 | A1 * | 9/2006 | Ali | 383/10 |
| 2007/0009185 | A1 | 1/2007 | Lee | |
| 2008/0080794 | A1 | 4/2008 | Kruse et al. | |

FOREIGN PATENT DOCUMENTS

| | | | | |
|---|---|---|---|---|
| FR | 2529528 | | 1/1984 | |
| FR | 2692868 | | 6/1992 | |
| GB | 2 171 077 | | 8/1986 | |
| JP | 03226460 | | 10/1991 | |
| JP | 03242156 | | 10/1991 | |
| JP | 09183442 | A * | 7/1997 | B65D 33/08 |
| JP | 10273153 | A * | 10/1998 | B65D 30/16 |
| JP | 2002-284186 | | 10/2002 | |
| JP | 2003-267397 | | 9/2003 | |
| KR | 10-0382617 | | 5/2003 | |
| WO | WO 03002043 | A2 * | 1/2003 | A61F 5/44 |

OTHER PUBLICATIONS

English translation of abstract related to FR2529528, espacenet.com, 1 page.

Hamer Automated Packaging Systems Brochure, Spring 2008, vol. 10, No. 1, www.hamerinc.com, 4 pages.

Color Photograph of Quaker State Peak Performance Bottle, 1 page.

International Search Report and Written Opinion dated Apr. 6, 2010, in corresponding PCT/US2009/055070 filed Aug. 26, 2009, 11 pages.

* cited by examiner

TWO-HANDLED BAG

BACKGROUND OF THE INVENTION

1. Field of the Invention

The present invention is broadly concerned with the field of bags for holding pourable products such as salt, and more particularly bags having a second handle configured for pouring. In another embodiment, the inventive bags also include a third handle.

2. Description of the Prior Art

Bag are commonly used to hold and transport pourable products (i.e., products comprising numerous small pieces). Such products include salt cubes or pellets, animal food, flour, and sugar, to name a few. These pourable products are typically sold in large quantities (e.g., 30-50 lbs.) and in bulk sizes that are difficult for the average person to handle. Even more difficult than carrying these bags is pouring the product from the bulky bag. That is, the consumer must open the bag, attempt to pick up the very heavy bag, and carefully pour the product in a controlled manner. This often results in spilling of the product, which goes from not coming out at all to rapidly falling from the bag and outside of the target area.

This problem is exacerbated in situations where the product must be poured into an opening that is higher than ground level (e.g., into a water softener) because now the consumer must hoist the heavy bag even higher while attempting to carefully pour the product. This awkward lifting and pouring is not only an inconvenience, but it can lead to back and muscle strain or injury. Many attempts have been made to overcome these problems, but they have all been lacking in some way. There is a need for a bag that not only provides for easier transport of these bulk products, but also allows the consumer to more readily handle the bag and pour product from the bag, while not compromising the strength of the bag.

SUMMARY OF THE INVENTION

The present invention overcomes the problems of the prior art by providing for such a bag. In one embodiment, the bag comprises front and back panels having: first and second end portions presenting respective outermost edges; and first and second side portions presenting respective outermost edges. The front and back panels and end and side portions cooperate to form a chamber for holding the pourable product. The bag includes a first handle at the first end portion, with the improvement being that the bag comprises a second handle and a seam at the first side portion, and the seam is spaced away from the outermost edge of the first side portion.

In another embodiment, the bag comprises front and back panels having: first and second end portions presenting respective outermost edges; and first and second side portions presenting respective outermost edges. The front and back panels and end and side portions cooperate to form a chamber for holding the pourable product. The bag also comprises a first handle at the first end portion. The first side portion has a centerpoint defined as a point that is halfway between the end portion outermost edges, and the first side portion has a first half on the side of the centerpoint that is adjacent the first end portion and a second half on the side of the centerpoint that is remote from the first end portion. The first end portion and the second side portion cooperate to form a first corner, with the improvement being that the bag comprises a second handle positioned entirely within the second half, and the first corner comprises a pouring spout.

In a further embodiment, the invention provides a method of dispensing a pourable product from a bag. The method comprises providing a bag comprising front and back panels including: first and second end portions having respective outermost edges; and first and second side portions having respective outermost edges. The front and back panels and end and side portions cooperate to form a chamber having a quantity of the pourable product therein. The bag further comprises a first handle at the first end portion, a second handle at the first side portion, and a seam at the first side portion that is spaced away from the outermost edge of the first side portion. After providing a bag, the method further comprises gripping the second handle and tilting the bag so as to cause the pourable product to exit the bag.

Finally, in a further embodiment, the method of dispensing a pourable product comprises providing a bag comprising front and back panels including: first and second end portions having respective outermost edges; and first and second side portions having respective outermost edges. The first side portion has a centerpoint defined as a point that is halfway between the end portion outermost edges. The first side portion further has a first half on the side of the centerpoint that is adjacent the first end portion and a second half on the side of the centerpoint that is remote from the first end portion. The front and back panels and end and side portions cooperate to form a chamber having a quantity of the pourable product therein. Further, the first end portion and the second side portion cooperate to form a first corner comprising a pouring spout. The bag further comprises a first handle at the first end portion and a second handle positioned entirely within the second half. After providing the bag, the method further comprises gripping the second handle and tilting the bag so as to cause the pourable product to exit the bag.

BRIEF DESCRIPTION OF THE DRAWINGS

Figure (FIG.) 1 is a front isometric view of a bag according to the invention.

DETAILED DESCRIPTION OF THE PREFERRED EMBODIMENTS

Figure 1:
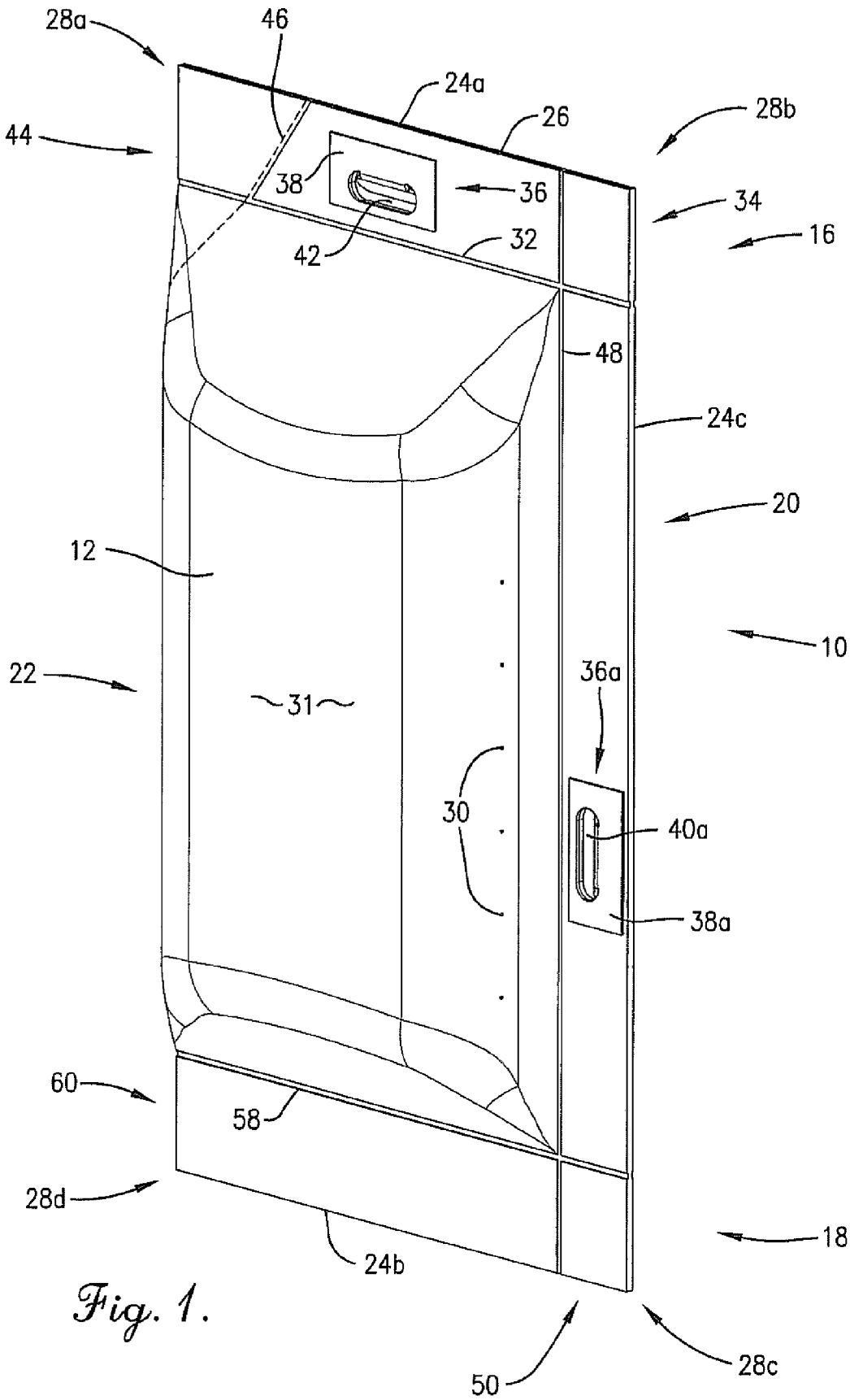
Figure 2:
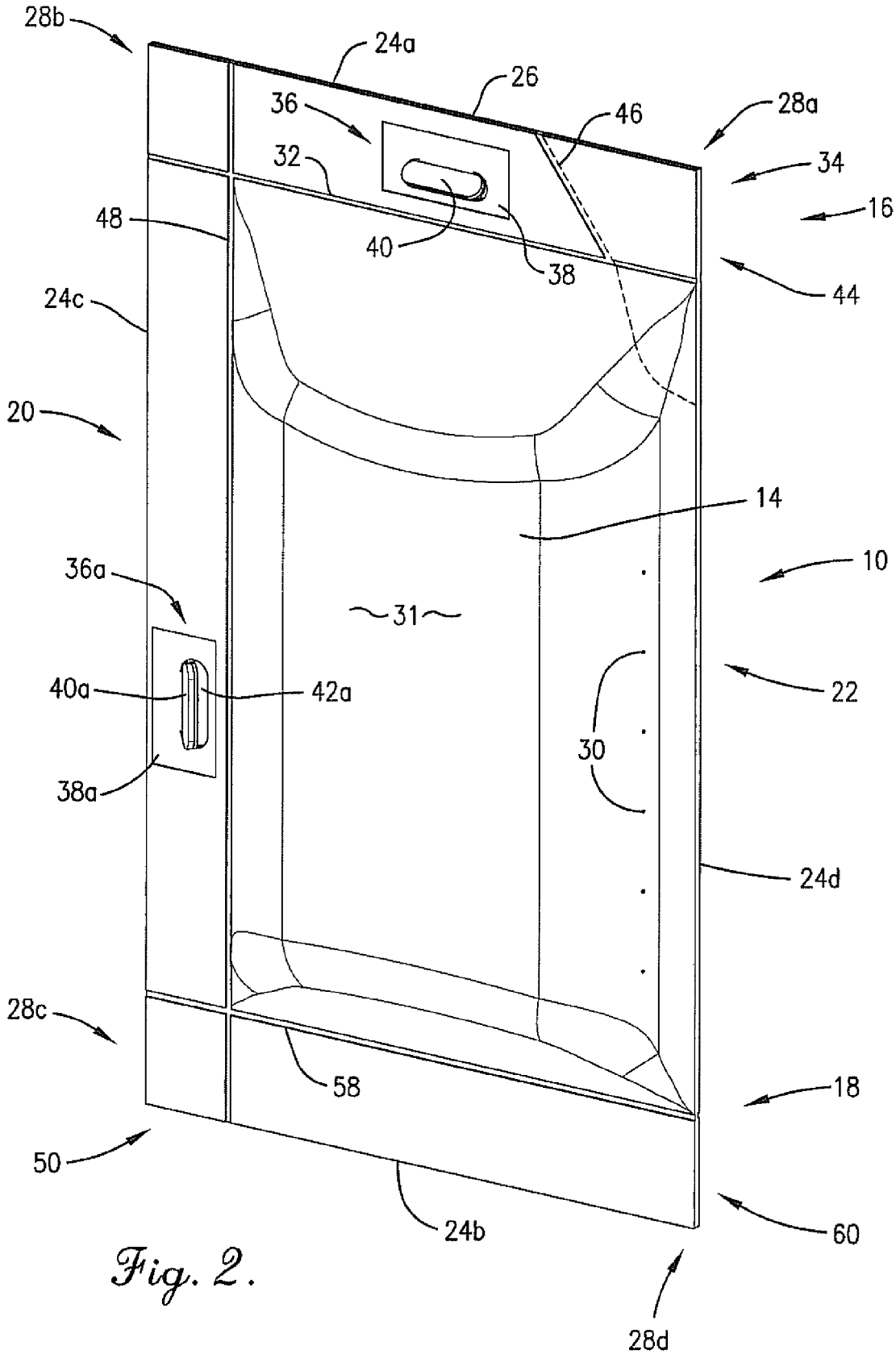
FIG. 2 is a rear isometric view of a bag according to the invention.
Figures 3, 4:
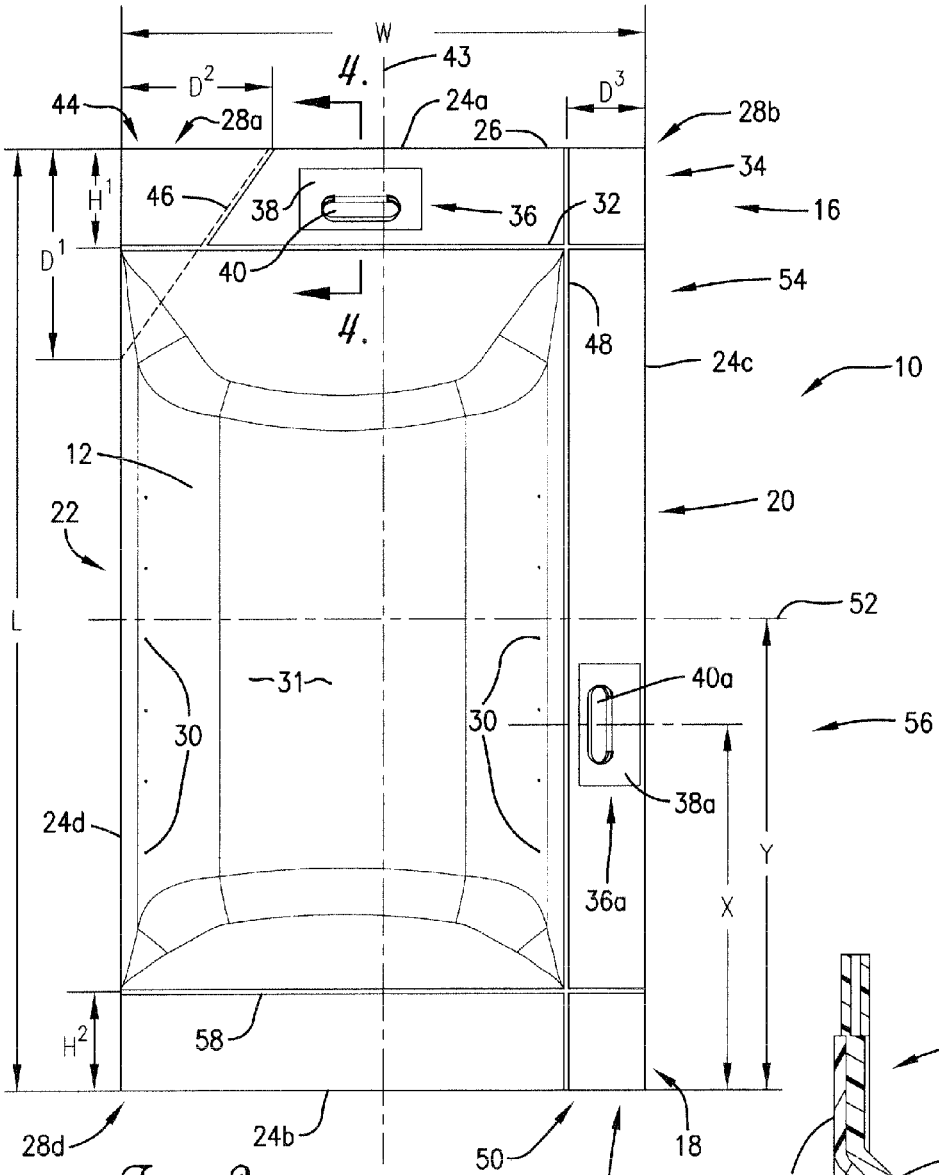
FIG. 3 is a front elevation view of a bag according to the invention.
FIG. 4 is a fragmentary section view of one of the handles of a bag according to the invention, with the view being taken along line 4-4 of FIG. 3.

With reference to FIGS. 1-3, a bag 10 already filled with pourable product is illustrated. Bag 10 includes a front panel 12 and a back panel 14. As shown, front and back panels 12,14 are rounded to demonstrate their respective shapes when filled with product. Front panel 12 and back panel 14 share a first end portion 16 and a second end portion 18.

Front panel 12 and back panel 14 further share a first side portion 20 and a second side portion 22. First and second end portions 16, 18 and first and second side portions 20, 22 present respective outermost edges 24*a-d*, which define an outer boundary or periphery 26 of the bag 10. Outermost edges 24*a* and 24*b* oppose, and are substantially parallel to, one another, while outermost edges 24*c* and 24*d* oppose, and are substantially parallel to, one another. Furthermore outermost edges 24*c* and 24*d* are substantially perpendicular to outermost edges 24*a* and 24*b*.

Each of the first and second end portions 16, 18 intersects with first and second side portions 20, 22 at corners 28*a-d*.

Front and back panels 12, 14 as shown include microvents 30, although microvents 30 may be omitted, depending upon the end use of the bag 10. Front and back panels 12, 14, first and second end portions 16, 18, and first and second side portions 20, 22 cooperate to form a chamber 31 for holding a pourable product (not shown).

First end portion 16 comprises a first horizontal seam 32 spaced apart from outermost edge 24*a*, thus forming a first flap 34 in first end portion 16. First horizontal seam 32 has a thickness of from about 1/16 inch to about 1/4 inch (and more preferably about 1/8 inch) and is substantially parallel to outermost edge 24*a*. First flap 34 comprises a first handle 36 formed therein and shown in greater detail in FIG. 4. Handle 36 comprises a patch 38 that is heat-sealed to the first flap 34. Patch 38 could be heat-sealed on either side of the first flap 34 (i.e., on front panel 12 or on back panel 14), or on both sides if extra strength is required. Patch 38 can be any material typically used for bags carrying bulk products, including plastics such as linear low density polyethylenes (LLPDE). A C-shaped grip 40 is formed through patch 38 and first flap 34 to form opening 42, through which a user may place his or her fingers during carrying, pouring, etc.

Outmost edge 24*a* of first end portion 16 is bisected by centerline 43 (see FIG. 3). In a preferred embodiment, first handle 36 is positioned such that some portion of the grip 40 falls upon the centerline 43. Also, while it will be appreciated that the first handle 36 is integrally formed with the bag 10 (and particularly with first flap 34) as described above, one may also substitute an integrally formed handle with a separately formed handle that is then physically attached to the bag 10. Also, first flap 34 could include a small opening (not shown) in or around corner 28*b* to provide a place for the user to place his or her finger during pouring to assist with that process.

First end portion 16 also preferably comprises a pouring spout 44, preferably at corner 28*a*. In the preferred embodiment, the spout 44 comprises microperforations 46, which allow for easy opening of the spout 44 at the time of use.

First side portion 20 preferably comprises a longitudinal seam 48 spaced apart from outermost edge 24*c*, thus forming a second flap 50 in first side portion 20. Longitudinal seam 48 has a thickness of from about 1/16 inch to about 1/4 inch (and more preferably about 1/8 inch), is substantially parallel to outermost edge 24*c*, and substantially perpendicular to first horizontal seam 32. In an alternative embodiment, the longitudinal seam 48 can be omitted so that chamber 31 extends to outermost edge 24*c*. Second flap 50 comprises a second handle 36*a* formed therein. The construction of handle 36*a* is identical to that of handle 36 as shown in FIG. 4, with like parts being similarly numbered. Thus, handle 36*a* comprises a patch 38*a* that is heat-sealed to the second flap 50. Patch 38*a* could be heat-sealed on either side of the second flap 50 (i.e., on front panel 12 or on back panel 14), or on both sides if extra strength is required. Patch 38*a* can be any material typically used for bags carrying bulk product, including plastics such as LLPDE. A C-shaped grip 40*a* is formed through patch 38*a* and second flap 50 to form opening 42*a*, through which a user may place his or her fingers during carrying, pouring, etc.

Outmost edge 24*c* of first side portion 20 is bisected by centerline 52 (see FIG. 3), thus defining a first half 54 and a second half 56 of first side portion 20. In a preferred embodiment, second handle 36*a* is positioned such that it falls entirely within second half 56. In another preferred embodiment, second handle 36*a* falls entirely within outer periphery 26. Furthermore, while it will be appreciated that the first handle 36*a* is integrally formed with the bag 10 (and particularly with second flap 50) as described above, one may also substitute an integrally formed handle with a separately formed handle that is then physically attached to the bag 10 at a similar location relative to centerline 52.

Second end portion 18 comprises a second horizontal seam 58 spaced apart from outermost edge 24*b*, thus forming a third flap 60 in second end portion 18. Second horizontal seam 58 is substantially parallel to outermost edge 24*b* and first horizontal seam 32. Second horizontal seam 58 is also substantially perpendicular to longitudinal seam 48.

Referring to FIG. 3, several dimensions of the inventive bag 10 have been defined. The ranges for those dimensions are shown in Table 1.

TABLE 1

| Preferred Bag Dimensions | | | |
|---|---|---|---|
| Dimension from FIG. 3 | Broad Range (inches) | Preferred Range (inches) | Most Preferred Range (inches) |
| L | about 20 to about 35 | about 24 to about 30 | about 26 to about 28 |
| W | about 10 to about 24 | about 14 to about 20 | about 16 to about 18 |
| $D^1$ | about 5 to about 7 | about 5.3 to about 6.7 | about 5.7 to about 6.5 |
| $D^2$ | about 4 to about 6 | about 4.3 to about 5.3 | about 4.6 to about 5.1 |
| $D^3$ | about 2 to about 3 | about 2.1 to about 2.9 | about 2.3 to about 2.7 |
| $H^1$ | about 1.8 to about 3.5 | about 2.1 to about 3.0 | about 2.4 to about 2.8 |
| $H^2$ | about 1.8 to about 3.5 | about 2.1 to about 3.0 | about 2.4 to about 2.8 |
| X | about 6 to about 13 | about 7 to about 11 | about 8 to about 10 |
| X/Y | about 0.45 to about 0.85 | about 0.55 to about 0.75 | about 0.6 to about 0.7 |

Figure 5:
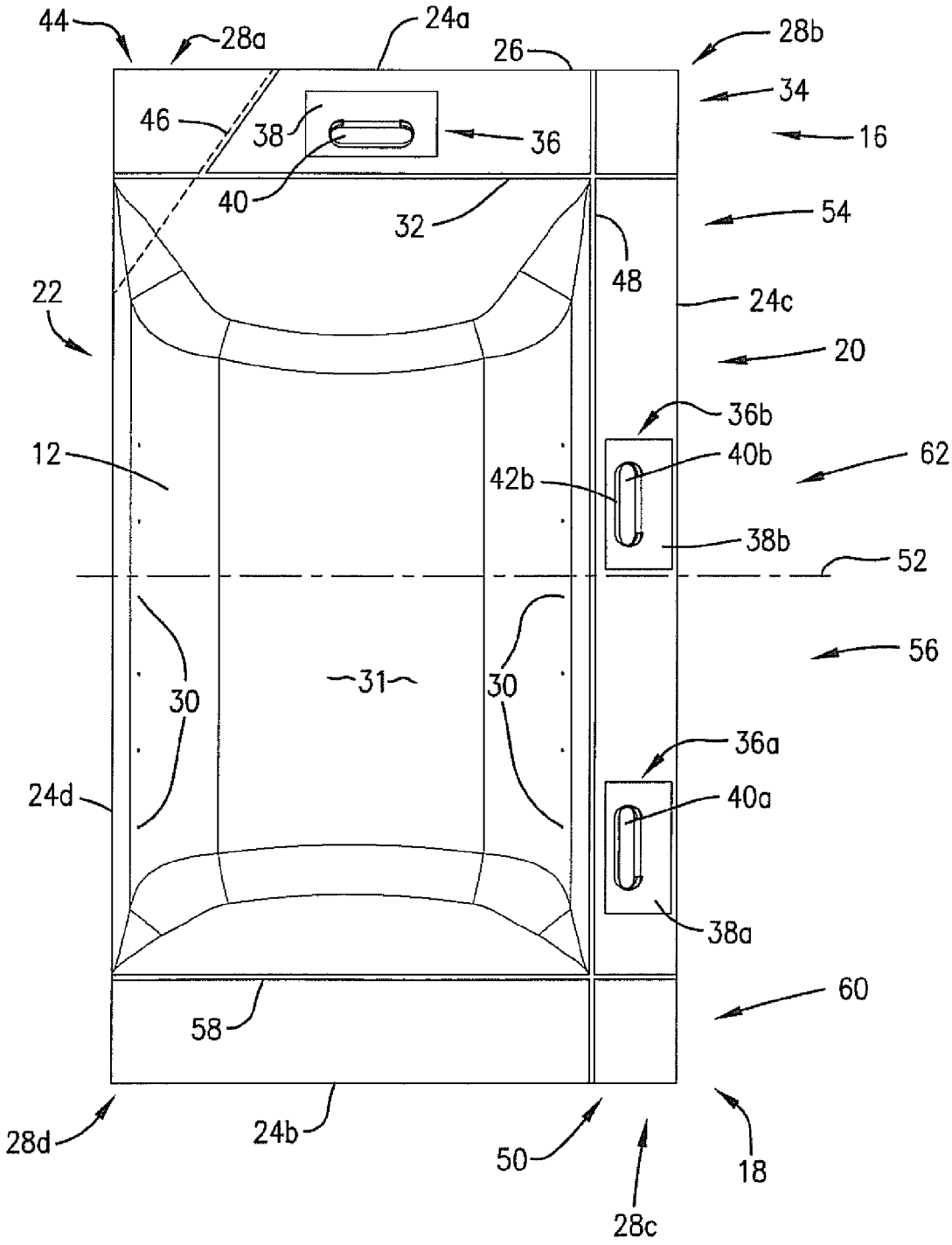
FIG. 5 is a front elevation view of an alternative embodiment of a bag according to the invention.

FIG. 5 depicts an alternative embodiment of the present invention, where like parts have been assigned like numbering. In this embodiment, a bag 62 is shown. The second handle 36*a* has been shifted from about 1 inches to about 4 inches, and more preferably from about 2 inches to about 3 inches, in the direction of second end portion 18. Thus, X/Y in this embodiment is from about 0.3 to about 0.6, preferably from about 0.4 to about 0.6, and more preferably from about 0.5 to about 0.6.

Bag 62 also includes a third handle 36*b*. The construction of handle 36*b* is preferably identical to that of handles 36 and 36*a* described above. Thus, handle 36*b* comprises a patch 38*b* that is heat-sealed to the second flap 50. Patch 38*b* could be heat-sealed on either side of the second flap 50 (i.e., on front panel 12 or on back panel 14), or on both sides if extra strength is required. As was the case with patches 38 and 38*a*, patch 38*b* can be any material typically used for bags carrying bulk product, including plastics such as LLPDE. A C-shaped grip 40*b* is formed through patch 38*b* and second flap 50 to form opening 42*b*, through which a user may place his or her fingers during carrying, pouring, etc. The handle 36*b* is preferably positioned entirely within first half 54. It will be appreciated that the inclusion of third handle 36*b* offers a number of significant benefits, including providing additional pouring assistance as well as making it easier to carry bag 62 and to remove bag 62 from a pallet.

The inventive bag 10 (or bag 62) can be manufactured by various methods, but the preferred method is described herein. First, a tube or sleeve of plastic is cut to the desired length (represented by "L" in FIG. 3). The plastic of which the inventive bag is formed can be any material typically used to form bags carrying bulk products. The plastic should be flexible and stretchable so that the bag collapses as the bulk product is poured from the bag. Preferably, the plastic of which the bag is formed stretches from about 1 to about 2 times at yield, and more preferably about 1.5 times at yield. Furthermore, it is preferred that the bag be formed of a plastic that stretches at least about 4 times, preferably at least about 5 times, and more preferably from about 5 to about 7 times at its break point. Thus, the preferred plastic has an ASTM D882 percent elongation of from about 200% to about 800%, preferably from about 400% to about 700%, and more preferably from about 500% to about 650%. The thickness of the preferred plastic is from about 2 mil to about 14 mil, preferably from about 4 mil to about 10 mil, and more preferably from about 6 mil to about 8 mil. The most preferred material is LLDPE.

A heat seal is then applied at first end portion 16 in order to form horizontal seam 32. A film (typically having a 10-mil thickness) is heat-sealed to first flap 34 to form patch 38. C-shaped grip 40 is then cut (e.g., die-cut) through the patch 38) and flap 34, thus forming handle 36, which serves as the primary carrying handle. The microperforations 46 can be added at this time according to conventional methods in order to form pouring spout 44.

Next, a heat seal is applied at first side portion 20 in order to form longitudinal seam 48. A film (again, typically having a 10-mil thickness) is heat-sealed to second flap 50 to form patch 38*a*. C-shaped grip 40*a* is then cut (e.g., die-cut) through the patch 38*a* and second flap 50, thus forming handle 36*a*, which primarily serves as the pouring handle. In embodiments where third handle 36*b* is included, that handle can be formed in a similar manner, either before or after the formation of handle 36*a*.

The microvents 30 can be added via conventional methods at any convenient time during manufacturing. The manufactured bag can then be stored until needed, or immediately filled and sealed. Either way, after the bag 10 is filled to the desired level, a final heat seal is applied at second end portion 18 to create second horizontal seam 58, making the filled bag 10 ready for distribution. It will be appreciated that the inventive bag 10 can be used to transport and store numerous types of pourable products, including cubes, pellets, tablets, powders, compacted pieces, and/or granules of those selected from the group consisting of: salt (e.g., water softening, pool treatment, deicing, etc.); animal food (e.g., bird seed, grain, dog or cat food); bulk flour or sugar; cement; seed (e.g., grass seed) and other lawn and garden products; fertilizers; ice; sand; rice; spices; soil (including soil mixtures); pesticides (e.g., fire ant treatments); industrial chemicals; mortar; plaster; marble dust; stones (including pebbles and gravel); and constructions products. Such products will typically cause the bags to weigh from about 20 lbs. to about 100 lbs., and more typically from about 40 lbs. to about 60 lbs.

In use, both handles 36 and 36*a*, as well as handle 36*b* in embodiments where it is included, could be used for loading and unloading the bag 10, although handle 36 is the primary carrying handle. Before pouring, a user would tear microperforations 46 to remove corner 28*a* at spout 44, so that spout 44 is ready for pouring. One hand can optionally be used to grip handle 36, while the second hand can be used to grip handle 36*a* or handle 36*b*, if present. It will be appreciated that the hand gripping handle 36*a* (and handle 36*b*, when present) will be able to controllably tilt the bag 10 into a pouring position while the product is poured from the bag 10. This controlled pouring allows for fairly exact dispensing of the product, while preventing spillage and waste of the product. Furthermore, the longitudinal seam 48 provides substantial extra strength to the overall bag and particularly to the second handle 36*a* (and handle 36*b*, if included), an advantage that is missing from the prior art. Finally, the use of two or even three handles provides the user with more carrying and pouring options that will substantially reduce the likelihood of back injury to the users.

We claim:

1. A bag for holding a pourable product, said bag comprising:

a front panel and a back panel, each of said front and back panels including— first and second end portions presenting respective first and second outermost end edges, and first and second side portions presenting respective first and second outermost side edges, said first outermost end edge being at least substantially parallel to said second outermost end edge, said first outermost side edge being at least substantially parallel to said second outermost side edge, said first side portion having a centerpoint defined as a point that is halfway between the first and second outermost end edges, said first side portion having a first half on the side of the centerpoint that is adjacent the first end portion and a second half on the side of the centerpoint that is remote from the first end portion, said front and back panels cooperatively defining a chamber for holding the pourable product, said first end portions and said second side portions cooperatively defining a first corner comprising a spout for pouring the pourable product;

a first end seam at the first end portions, said first end seam spaced away from and extending at least substantially parallel to the first outermost end edges to at least in part define an at least substantially rectangular first end flap extending between and interconnecting the first end seam, the first outermost end edges, and the first and second outermost side edges;

a first side seam at the first side portions, said first side seam spaced away from and extending at least substantially parallel to the first side edges to at least in part define an at least substantially rectangular first side flap extending between and interconnecting the first side seam, the first outermost side edges, and the first and second outermost end edges;

a first end handle being defined at least in part by an opening that extends through the panels within the first end flap, said first end handle being spaced from said first side flap, said first end handle opening being elongated and extending lengthwise in a direction at least substantially parallel to the first end seam and the first outermost end edges; and a first side handle being defined at least in part by an opening that extends through the panels within the first side flap, said first side handle being spaced from said first end flap, said first side handle opening being elongated and extending lengthwise in a direction at least substantially parallel to the first side seam and the first outermost side edges, said first side handle being positioned entirely within the second half of the first side portions, said pouring spout extending oblique to said first end handle and said first side handle.

2. The bag of claim 1, wherein said outermost end edges and said outermost side edges define an outer periphery of said bag, and said first end handle and said first side handle are positioned entirely within said outer periphery.

3. The bag of claim 1, wherein said chamber includes therein a quantity of the pourable product, said product being selected from the group consisting of salt, animal food, flour, sugar, cement, seed, fertilizer, ice, sand, rice, spices, soil, pesticides, industrial chemicals, mortar, plaster, marble dust, and stones.

4. The bag of claim 1, said bag further comprising a second side handle at said first side portions.

5. The bag of claim 1, wherein said pouring spout comprises a perforated section of said first corner.

6. The bag of claim 1, said bag being at least substantially rectangular in shape.

7. The bag of claim 1, said bag being devoid of additional handles beyond the first end handle and the first side handle.

8. The bag of claim 1, said first end handle and said first side handle each being further defined by respective reinforcement patches surrounding the respective openings.

9. A bag for holding a pourable product, said bag comprising:

a front panel and a back panel, each of said front and back panels including— first and second end portions presenting respective first and second outermost end edges, and first and second side portions presenting respective first and second outermost ide edges, said first outermost end edge being at least substantially parallel to said second outermost end edge, said first outermost side edge being at least substantially parallel to said second outermost side edge, said first side portion having a centerpoint defined as a point that is halfway between the first and second outermost end edges, said first side portion having a first half on the side of the centerpoint that is adjacent the first end portion and a second half on the side of the centerpoint that is remote from the first end portion, said front and back panels cooperatively defining a chamber for holding the pourable product, said first end portions and said second side portions cooperatively defining a first corner comprising a spout for pouring the pourable product;

a first end seam at the first end portions, said first end seam spaced away from and extending at least substantially parallel to the first outermost end edges to at least in part define an at least substantially rectangular first end flap extending between and interconnecting the first end seam, the first outermost end edges, and the first and second outermost side edges;

a first side seam at the first side portions, said first side seam spaced away from and extending at least substantially parallel to the first side edges to at least in part define an at least substantially rectangular first side flap extending between and interconnecting the first side seam, the first outermost side edges, and the first and second outermost end edges;

a first end handle being defined at least in part by an opening that extends through the panels within the first end flap, said first end handle being spaced from said first side flap, said first end handle opening being elongated and extending lengthwise in a direction at least substantially parallel to the first end seam and the first outermost end edges; and a first side handle being defined at least in part by an opening that extends through the panels within the first side flap, said first side handle being spaced from said first end flap, said first side handle opening being elongated and extending lengthwise in a direction at least substantially parallel to the first side scam and the first outermost side edges, said first side handle being positioned entirely within the second half of the first side portions, said bag being devoid of additional handles beyond the first end handle and the first side handle.

10. The bag of claim 9, wherein said outermost end edges and said outermost side edges define an outer periphery of said bag, and said first end handle and said first side handle are positioned entirely within said outer periphery.

11. The bag of claim 9, wherein said chamber includes therein a quantity of the pourable product, said product being selected from the group consisting of salt, animal food, flour, sugar, cement, seed, fertilizer, ice, sand, rice, spices, soil, pesticides, industrial chemicals, mortar, plaster, marble dust, and stones.

12. The bag of claim 9, wherein said pouring spout comprises a perforated section of said first corner.

13. The bag of claim 9, said pouring spout extending oblique to said first end handle and said first side handle.

14. The bag of claim 9, said hag being at least substantially rectangular in shape.

15. The bag of claim 9, said first end handle and said first side handle each being further defined by respective reinforcement patches surrounding the respective openings.

* * * * *

UNITED STATES PATENT AND TRADEMARK OFFICE

CERTIFICATE OF CORRECTION

PATENT NO. : 8,794,833 B2
APPLICATION NO. : 12/200728
DATED : August 5, 2014
INVENTOR(S) : Michael Ray Runyon et al.

It is certified that error appears in the above-identified patent and that said Letters Patent is hereby corrected as shown below:

In the Claims

Column 6, lines 62-63, the text including the phrase "the first outermost end edges; and" should read:
--the first outermost end edges;--

Column 7, line 6, the text including the phrase "second half of the first side portions," should read:
--second half of the first side portions, and--

Column 8, lines 20-21, the text including the phrase "the first outermost end edges; and" should read:
--the first outermost end edges;--

Column 8, line 32, the text including the phrase "second half of the first side portions," should read:
--second half of the first side portions, and--

Signed and Sealed this
Twenty-first Day of April, 2015

Michelle K. Lee

Michelle K. Lee
*Director of the United States Patent and Trademark Office*